US009964109B2

(12) United States Patent
Patterson et al.

(10) Patent No.: US 9,964,109 B2
(45) Date of Patent: May 8, 2018

(54) APPARATUS FOR DRIVING FLUID HAVING A ROTATING CAM AND ROCKER ARM

(71) Applicant: Albert's Generator Services Inc., West Lorne (CA)

(72) Inventors: Albert W. Patterson, West Lorne (CA); Tyler J. E. Clark, Appin (CA)

(73) Assignee: ALBERT'S GENERATOR SERVICES INC., West Lorne (CA)

( * ) Notice: Subject to any disclaimer, the term of this patent is extended or adjusted under 35 U.S.C. 154(b) by 88 days.

(21) Appl. No.: 14/965,415

(22) Filed: Dec. 10, 2015

(65) Prior Publication Data

US 2017/0167488 A1 Jun. 15, 2017

(51) Int. Cl.

| | |
|---|---|
| ***F04C 2/344*** | (2006.01) |
| ***F04C 15/00*** | (2006.01) |
| ***F04C 18/356*** | (2006.01) |
| ***F04C 2/356*** | (2006.01) |
| ***F04C 29/00*** | (2006.01) |

(52) U.S. Cl.

CPC ..... *F04C 18/3568* (2013.01); *F04C 2/3568* (2013.01); *F04C 15/0069* (2013.01); *F04C 29/0064* (2013.01); *F04C 2240/30* (2013.01)

(58) Field of Classification Search

CPC .... F01C 1/3448; F01C 1/3568; F01C 21/108; F01C 21/0845; F01C 1/067; F01C 17/04; F01C 21/0836; F04C 2/3448; F04C 2/348; F04C 2/3568; F04C 18/3448; F04C 18/348; F04C 18/3568; F04C 29/0064; F04C 15/0069; F04C 2/067; F04C 18/067

See application file for complete search history.

(56) References Cited

U.S. PATENT DOCUMENTS

| | | | | |
|---|---|---|---|---|
| 349,108 | A * | 9/1886 | Lawrenz | F01C 1/3448 418/231 |
| 657,559 | A * | 9/1900 | Moats | F01C 1/3568 418/222 |
| 750,188 | A * | 1/1904 | Chapman | F01C 1/3448 418/231 |

(Continued)

FOREIGN PATENT DOCUMENTS

| | | |
|---|---|---|
| CA | 1108009 | 9/1981 |
| CA | 2863542 | 6/2015 |

(Continued)

*Primary Examiner* — Laert Dounis

(74) *Attorney, Agent, or Firm* — Bereskin & Parr LLP

(57) ABSTRACT

An apparatus for driving fluid includes a housing having an interior chamber in communication with a fluid inlet for receiving the fluid and a fluid outlet for expelling the fluid, a cam rotatably mounted within the interior chamber, the cam configured to drive fluid to flow, the cam having an annular channel formed therein, a working vane extending into the annular channel for sliding therein as the cam rotates, wherein the working vane divides the annular channel into an inlet chamber and an outlet chamber such that, as the cam rotates, the inlet chamber expands and the outlet chamber contracts, a follower vane extending into the annular channel for sliding therein as the cam rotates, wherein the follower vane allows fluid to pass in the annular channel, and a rocker arm for providing dependent motion between the working vane and the follower vane.

20 Claims, 10 Drawing Sheets

(56) References Cited

U.S. PATENT DOCUMENTS

| | | | | | |
|---|---|---|---|---|---|
| 1,010,650 | A | * | 12/1911 | Lewis | F04C 2/3568 418/217 |
| 1,377,210 | A | * | 5/1921 | Lindsay | F04C 2/3448 192/59 |
| 1,931,207 | A | * | 10/1933 | Roberts | F04C 18/3448 418/230 |
| 2,232,599 | A | * | 2/1941 | Fehn | F01C 1/3448 418/230 |
| 2,324,610 | A | | 7/1943 | Williams | |
| 2,517,862 | A | * | 8/1950 | Frederick | F04C 2/3448 418/28 |
| 2,902,942 | A | | 9/1959 | Pelladeau | |
| 3,213,759 | A | | 10/1965 | Mellinger | |
| 3,456,594 | A | | 7/1969 | Cosby | |
| 3,769,945 | A | * | 11/1973 | Kahre | F01C 1/3568 418/217 |
| 3,787,153 | A | | 1/1974 | Williams | |
| 3,994,638 | A | | 11/1976 | Garland et al. | |
| 4,080,117 | A | | 3/1978 | Rasmussen | |
| 4,093,408 | A | | 6/1978 | Yamaguchi | |
| 4,096,845 | A | * | 6/1978 | Holmes | F01L 13/0005 123/1 R |
| 4,437,823 | A | | 3/1984 | Tigane | |
| 4,492,541 | A | * | 1/1985 | Mallen-Herrero | F01C 21/0818 188/290 |
| 4,561,831 | A | | 12/1985 | Mallen-Herrero et al. | |
| 4,573,892 | A | | 3/1986 | DuFrene | |
| 4,653,603 | A | | 3/1987 | DuFrene | |
| 6,773,244 | B2 | | 8/2004 | Lee et al. | |
| 6,893,241 | B2 | | 5/2005 | Yang | |
| 8,985,980 | B2 | | 3/2015 | Patterson et al. | |
| 8,985,981 | B2 | * | 3/2015 | Fromm | F04C 2/3568 418/130 |
| 2003/0108438 | A1 | | 6/2003 | Kim et al. | |

FOREIGN PATENT DOCUMENTS

| | | | | | |
|---|---|---|---|---|---|
| DE | 2410424 | A1 | * | 9/1975 | F01C 1/3448 |
| FR | 824309 | A | * | 2/1938 | F01C 1/3448 |
| WO | 03/044371 | | | 5/2003 | |

* cited by examiner

APPARATUS FOR DRIVING FLUID HAVING A ROTATING CAM AND ROCKER ARM

TECHNICAL FIELD

The embodiments disclosed herein relate to apparatus for driving fluids, and particular to such apparatus having one or more sliding end vanes for engaging a rotating cam to compress or pump the fluid.

INTRODUCTION

Compressors and pumps are commonly used to transfer mechanical energy to fluids. Some of these compressors and pumps have rotary designs, which can provide efficient and continuous energy transfer. However, these rotary designs are often complicated and expensive to manufacture and maintain.

One example of a rotary compressor is described in U.S. Patent Application Publication No. 2003/0108438 (Kim et al.). The compressor includes a cylinder assembly having a compression space through which suction passages and discharge passages are connected. A slanted compression plate is installed in the compression space and divides the compression space into two parts. The slant plate is rotatably connected to a rotation driving unit. Vanes are located on both sides of the slant compression plate to separate each of the two partitioned compression spaces into a suction space and a compression space. As the compression plate rotates, the vanes slide along the compression plate so that the fluid enters the suction space while fluid in the compression space is compressed and discharged.

One problem with the compressor of Kim et al. is that it can be difficult to maintain seals around the suction space and compression space on each side of the compression plate. Furthermore, it can be difficult to perform maintenance on the vanes or the slanted compression plate in the event that either of them wears down or breaks.

In view of the above, there is a need for a new apparatus for driving fluids.

U.S. patent application Ser. No. 13/742,663 filed on Jan. 16, 2013, issued to U.S. Pat. No. 8,985,980 on Mar. 24, 2015, entitled "Compressor with Rotating Cam and Sliding End Vanes", and U.S. patent application Ser. No. 14/663,816 filed on Mar. 3, 2015, published as U.S. Publication No. 2015-0192128A1 on Jul. 9, 2015, entitled "Compressor with Rotating Cam and Sliding End Vanes", the entire contents of which are hereby incorporated by reference herein for all purposes, describe rotating compressors and cams with sliding end vanes.

SUMMARY

According to some embodiments, there is an apparatus for driving fluid that includes a housing having an interior chamber in communication with a fluid inlet for receiving the fluid and a fluid outlet for expelling the fluid, a cam rotatably mounted within the interior chamber, the cam configured to drive fluid to flow, the cam having an annular channel formed therein, a working vane extending into the annular channel for sliding therein as the cam rotates, wherein the working vane divides the annular channel into an inlet chamber and an outlet chamber such that, as the cam rotates, the inlet chamber expands and the outlet chamber contracts, a follower vane extending into the annular channel for sliding therein as the cam rotates, wherein the follower vane allows fluid to pass in the annular channel, and a rocker arm for providing dependent motion between the working vane and the follower vane.

In an embodiment, the rocker arm has a first arm end engaging the working vane and a second arm end engaging the follower vane. The first and second arm ends are on opposite sides of a rocker pivot to provide opposed motion of the working vane relative to the follower vane.

In an embodiment, the second arm end includes a rocker magnetic element. The follower vane includes a vane magnetic element that is magnetically opposed to the rocker magnetic element.

In an embodiment, the apparatus includes a spring connected at one end to the follower vane and connected at the other end to the second arm end. In an embodiment, the spring includes a coil spring or a leaf spring.

In an embodiment, the cam is reversible such that fluid will flow in a reverse direction when the cam is rotated in a reverse direction.

In an embodiment, the apparatus includes a rocker mount pivotally mounting the rocker arm to the housing.

In an embodiment, the cam has a cam rotational axis and the rocker arm has a rocker arm rotational axis. The cam rotational axis is perpendicular to the rocker arm rotational axis.

In an embodiment, the rocker arm frictionally contacts the working vane.

In an embodiment, the apparatus includes a drive mechanism for providing rotation to the cam.

In an embodiment, the follower vane has apertures to allow fluid to flow therethrough.

In an embodiment, the apertures are sized to have a height that is less than the depth of a follower vane socket.

According to some embodiments, there is an apparatus for driving fluid that includes a housing having a first interior chamber in communication with a first fluid inlet for receiving the fluid and a first fluid outlet for expelling the fluid, and a second interior chamber in communication with a second fluid inlet for receiving the fluid and a second fluid outlet for expelling the fluid, a cam rotatably mounted within the interior chamber, the cam configured to enable the fluid to flow, the cam having first and second annular channels formed therein, a first working vane extending into the first annular channel for sliding therein as the cam rotates, wherein, the first working vane divides the first annular channel into a first inlet chamber and a first outlet chamber such that, as the cam rotates, the first inlet chamber expands and the first outlet chamber contracts, a first follower vane extending into the first annular channel for sliding therein as the cam rotates, wherein the first follower vane allows fluid to pass in the first annular channel, a first rocker arm providing dependent motion between the first working vane and the first follower vane, a second working vane extending into the second annular channel for sliding therein as the cam rotates, wherein the second working vane divides the second annular channel into a second inlet chamber and a second outlet chamber such that, as the cam rotates, the second inlet chamber expands and the second outlet chamber contracts, a second follower vane extending into the second annular channel for sliding therein as the cam rotates, wherein the second follower vane allows fluid to pass in the second annular channel, and a second rocker arm providing dependent motion between the second working vane and the second follower vane.

In an embodiment, the first working vane is coincident with the second working vane.

In an embodiment, the first follower vane is coincident with the second follower vane.

In an embodiment, the first fluid inlet and the second fluid inlet are connected via an inlet conduit to a single conduit inlet, and wherein the first fluid outlet and the second fluid outlet are connected via an outlet conduit to a single conduit outlet.

In an embodiment, the fluid passes from the first annular channel to the second annular channel.

In an embodiment, the first annular channel drives a first fluid and the second annular channel drives a second fluid.

According to some embodiments, there is a method of driving fluid that includes receiving the fluid via a fluid inlet in communication with an interior chamber and expelling the fluid via a fluid outlet, rotating a cam mounted within the interior chamber and driving fluid to flow, the cam having an annular channel formed therein, reciprocating a working vane in the annular channel as the cam rotates, wherein the working vane divides the annular channel into an inlet chamber and an outlet chamber such that, as the cam rotates, the inlet chamber expands and the outlet chamber contracts, and reciprocating a follower vane in the annular channel as the cam rotates, wherein the follower vane allows fluid to pass in the annular channel, wherein extension of the follower vane is dependent on the retraction of the working vane.

In an embodiment, the method includes providing opposed motion of the working vane relative to the follower vane.

Other aspects and features will become apparent, to those ordinarily skilled in the an upon review of the following description of some exemplary embodiments.

BRIEF DESCRIPTION OF THE DRAWINGS

The drawings included herewith are for illustrating various examples of articles, methods, and apparatuses of the present specification. In the drawings.

DETAILED DESCRIPTION

Various apparatuses or processes will be described below to provide an example of each claimed embodiment. No embodiment described below limits any claimed embodiment and any claimed embodiment may cover processes or apparatuses that differ from those described below. The claimed embodiments are not limited to apparatuses or processes having all of the features of any one apparatus or process described below or to features common to multiple or all of the apparatuses described below. It is possible that an apparatus or process described below is not covered by any of the claimed embodiments. Any embodiment disclosed below that is not claimed in this document may be the subject matter of another protective instrument, for example, a continuing patent application, and the applicants, inventors or owners do not intend to abandon, disclaim or dedicate to the public any such embodiment by its disclosure in this document. Throughout the description and drawings, it will be understood, that unless otherwise specified, the reference numbering may be applicable to both sides of the illustrated double sided design, as reference numbers may not be shown so as to not obscure the drawings.

Figure 1:
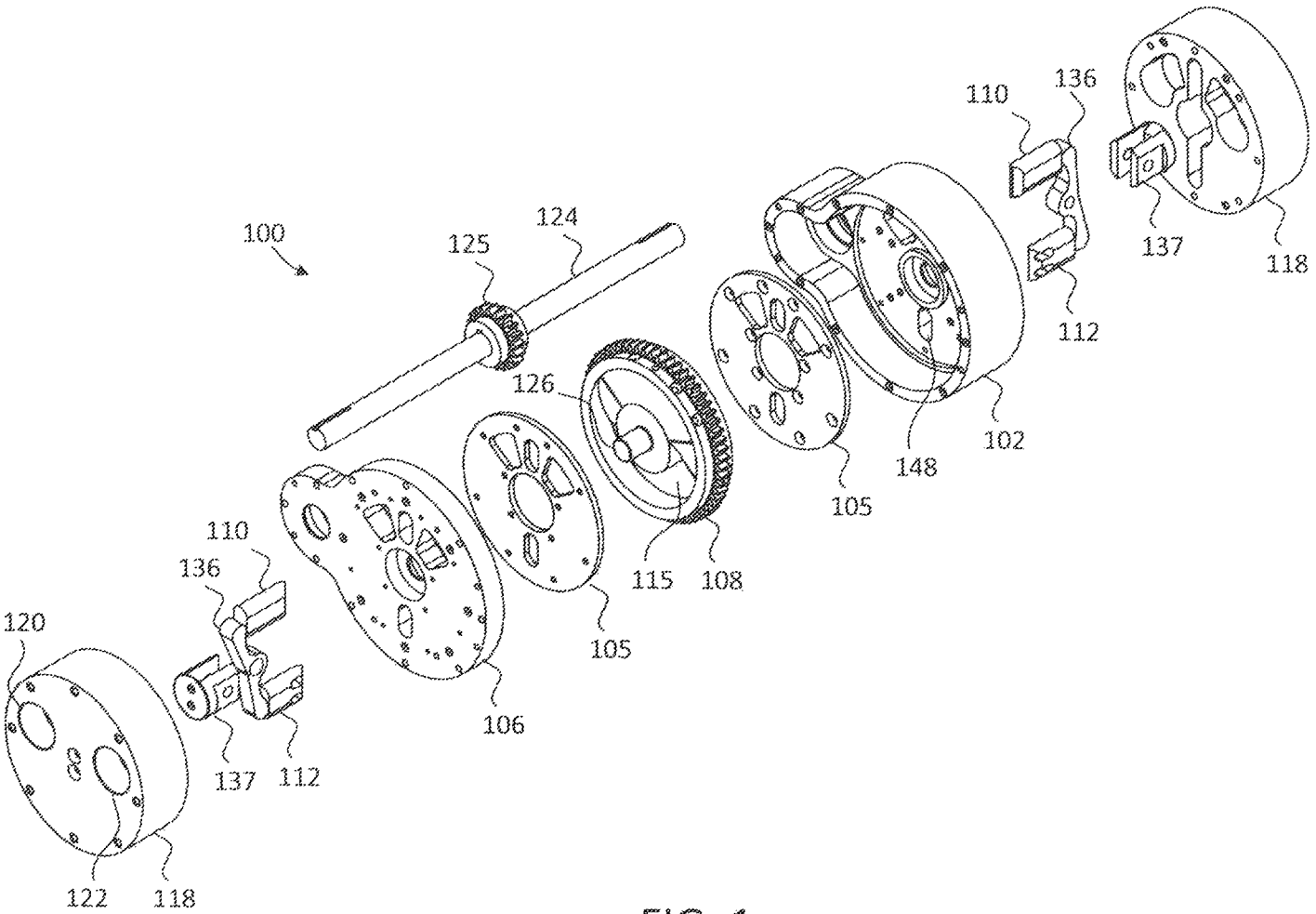
FIG. 1 is an exploded view of an apparatus for driving fluid, in accordance with an embodiment.
Figure 2:
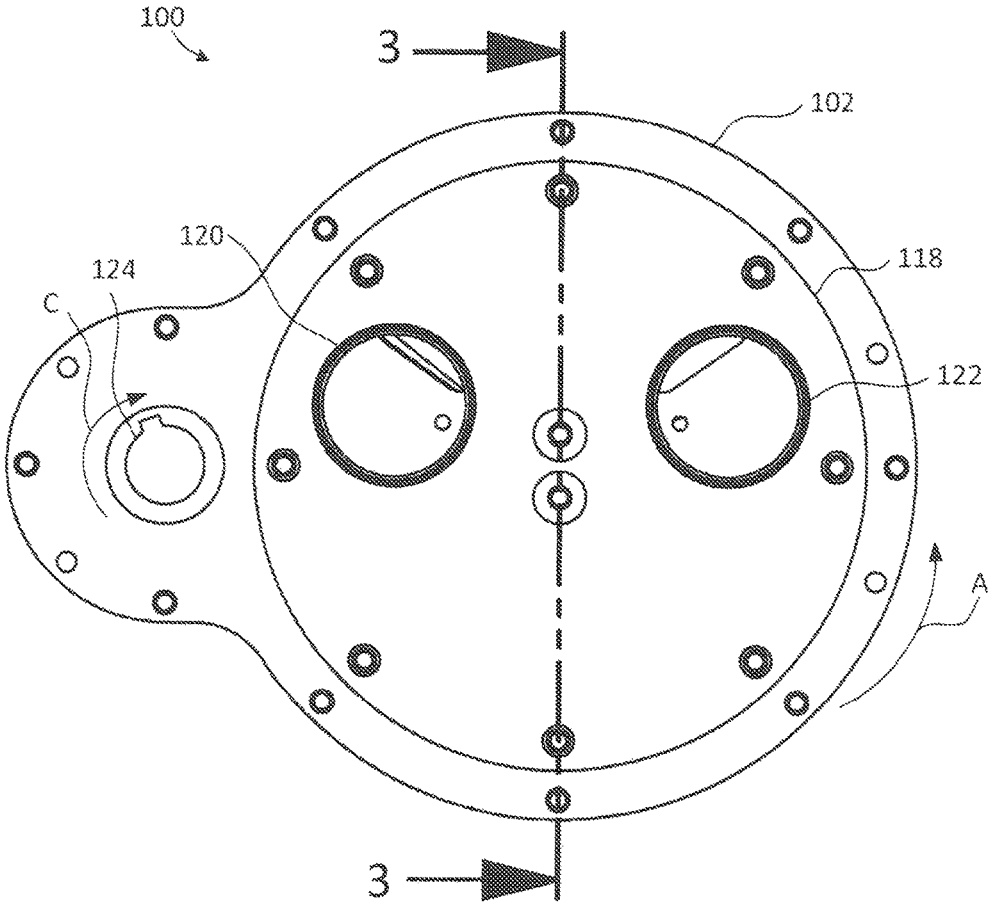
FIG. 2 is an end view of the apparatus of FIG. 1.
Figure 3:
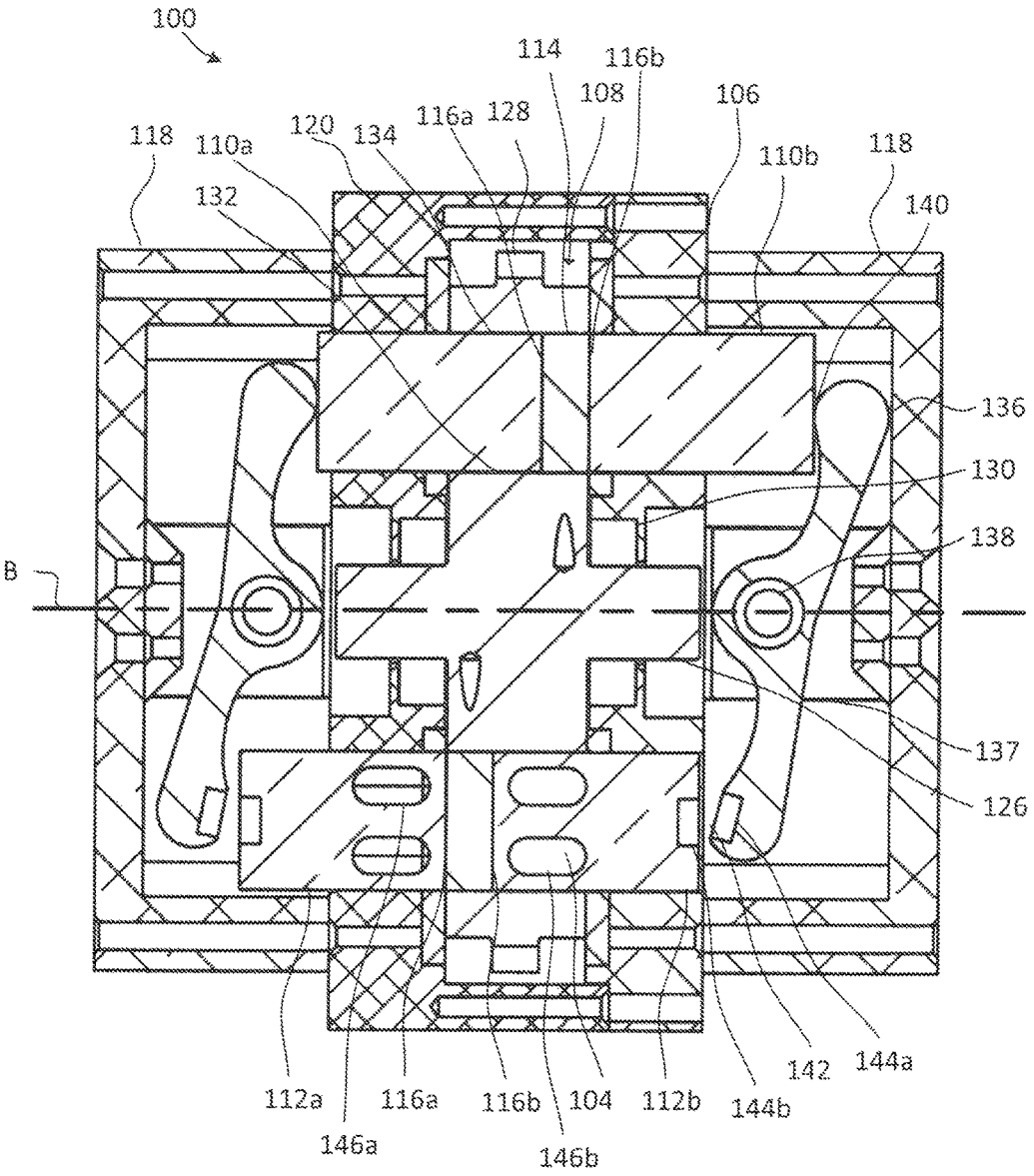
FIG. 3 is a sectional view along 3-3 of FIG. 2 of the apparatus of FIG. 1.

Referring to FIGS. 1 through 3, illustrated therein is an apparatus 100 for use in driving fluid. The apparatus 100 may compress or pump fluids. The apparatus 100 includes a housing 102 having an interior chamber 104 enclosed by two channel plates 105 and two end walls 106. The interior chamber 104 is in communication with a fluid inlet 120 for receiving the fluid and a fluid outlet 122 for expelling the fluid. The apparatus 100 includes a cam 108 rotatably mounted within the interior chamber 104. The cam 108 is configured to enable the fluid to flow. The cam 108 has an annular channel 115 formed therein.

The apparatus 100 includes at least one working vane 110 and at least one follower vane 112. The working vane 110 and follower vane 112 are mounted within the housing 102 and ride on the cam 108 in the annular channel 115. The apparatus 100 includes at least one rocker arm 136 that provides dependent motion between the working vane 112 and the follower vane 110. The rocker arm 136 biases the working and follower vanes 110, 112 towards the sloped annular channel 115. As such, it may not be necessary to have a hydraulic or spring mechanism for biasing the working vanes 110 towards the annular channel 115, as described in U.S. Pat. No. 8,985,980 ('980). As these systems for biasing may not be necessary, the system may be more compact, efficient, and easier to maintain and repair.

The working vane 110 extends into the annular channel 115 for sliding therein as the cam 108 rotates and operates similar to that of ('980). The working vane 110 pushes fluid through the annular channel 115 and out the fluid outlet 122. The working vane 110 divides the annular channel 115 into an inlet chamber and an outlet chamber such that, as the cam 108 rotates, the inlet chamber expands and the outlet chamber contracts to drive fluid.

The follower vane 112 extends into the annular channel 115 for sliding therein as the cam 108 rotates. The follower vane 112 allows fluid to pass in the annular channel 115. The follower vane 112 may be sized and shaped to provide a following action on the cam surface while allowing fluid to flow therethrough. The follower vane 112 may be sized similar to the working vane 110 such that any wear on the cam 108 will be similar to the working vane 110. For example, the follower vane 112 has one or more apertures 146*a*, 146*b* for allowing fluid to pass therethrough. The apertures 146*a*, 146*b* in the follower vane 112 may be sized to have a height that is less than the depth of a follower vane socket 148 in the end wall 102 in order to keep the fluid in the annular channel 115.

As seen in FIGS. 4 through 8, which illustrate the apparatus 100 with the housing removed, the follower vane 112 and working vane 110 drive each other. As the cam 108 rotates, the follower vane 112 retracts when the working vane 110 extends and the working vane 110 retracts when the follower vane 112 extends. The working vane 110 may be positioned opposite (e.g. 180 degrees) on the cam surface from the follower vane 112. The rocker arm 126 is mounted between the working vane 110 and the follower vane 112. As the follower vane 112 is retracted by the cam 108 the working vane 110 pushes the rocker arm 136, which pivots about rocker arm rotational axis D (shown in FIG. 6), and pushes the working vane 110 into an extended position. The working and follower vanes 110, 112 reciprocate up and down parallel to the cam rotational axis B as the working and follower vanes 110, 112 slide within the sloped annular channels 115. The working and follower vanes 110, 112 are generally biased toward the sloped annular channel 115.

Referring again to FIGS. 1 through 3, the apparatus 100 may also include a manifold block 118 having the fluid inlet 120 and the fluid outlet 122. The fluid inlet 120 and fluid outlet 122 are generally aligned with the sloped annular channel 115 on the cam body 114. Thus, as the cam 108 rotates in direction A, fluid can enter the sloped annular channels 115 through the fluid inlet 120, and can then be expelled through the fluid outlet 122.

The cam body 114 is rotatably mounted with a shaft 126 within the interior chamber 104 along a cam rotational axis B. The cam rotational axis B may be per to the rocker arm rotational axis D (shown in FIGS. 4 and 7). The cam body 114 may be rotated about the cam rotational axis B by a drive mechanism. The drive mechanism provides rotation to the cam 108. For example, the cam 108 includes a circumferential gear 128 located on an outer circumferential surface of the cam body 114. An external shaft 124 with a pinion gear 125 may be used to rotatably drive the circumferential gear 128 (e.g. in direction C). A bushing 130 may be positioned between the shaft 126 and each end wall 106 to allow for free rotation of the shaft 126 relative to the end wall 106. The external shaft 124 may be driven by a motor (not shown) or another source of rotary power. In an embodiment, the cam 108 may be driven exclusively by, or in addition to the external shaft 124.

In an embodiment, the drive mechanism is a 2, 4, 6, or 8 multi-pole motor with variable speed drives. In an alternative embodiment, the drive mechanism is a hand crank. The hand crank driven may be quiet (e.g. for military use to pump fuel). As the speed of the fluid flow increases, there may be an increase in energy loss, and it may be desirable to maintain a constant steady speed. A constant steady speed may also provide a reduction in friction, a reduction in heat generation, and an increase in sealable.

Figure 4:
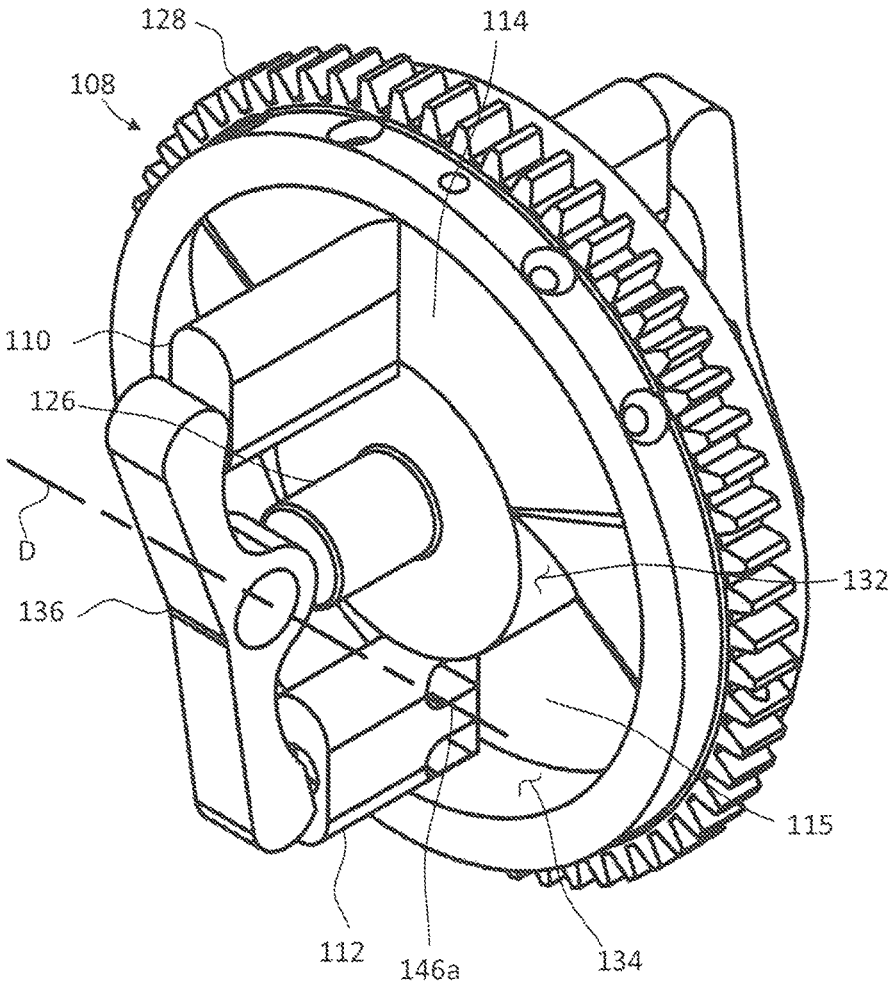
FIG. 4 is a perspective view of the apparatus of FIG. 1, shown without housing.
Figure 5:
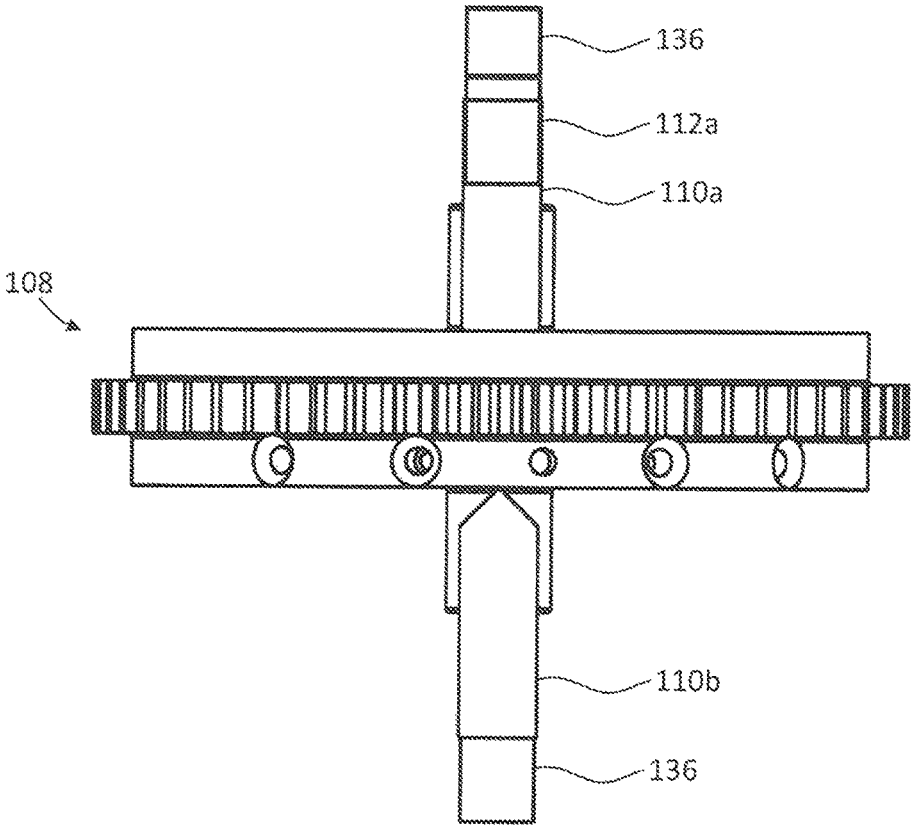
FIG. 5 is first side view the apparatus of FIG. 4.

Referring now to FIG. 4, the sloped annular channel 115 formed in the cam body 114 includes a ramp circumscribed by an inner circumferential sidewall 132 and an outer circumferential sidewall 134 that are generally sized and shaped to allow the working vane 110 to slide within the sloped annular channel 115 while maintaining a seal therebetween. The cam body 114 has a raised portion, a lowered portion, a ramp up portion, and a ramp down portion when rotating. The cam body 114 is generally symmetrical. The cam body 114 is configured to drive fluid to flow in a forward direction and a reverse direction. The cam body 114 is reversible such that the cam body 114 enables the fluid to flow in a reverse direction when the cam 108 is rotated in a reverse direction (e.g. opposite direction A). For example, the fluid will flow in the reverse direction when the cam body 114 is rotated in a direction opposite to that of direction A. The raised portion is generally flat and sized to cover the fluid inlet 120 and the fluid outlet 122. The fluid inlet 120 and the fluid outlet 122 are positioned proximal to the working vanes 110.

In an alternative embodiment, the apparatus 100 may include multiple channels on the same side of the cam 108.

As shown in FIG. 3, the cam 108 may be shaped to be double sided. The cam 108 includes a cam body 114 having two opposing ends 116*a*, 116*b* with cam surfaces thereon. Each end 116*a*, 116*b* is located adjacent to one of the end walls 106 of the housing 102. Each cam surface is defined by the sloped annular channel 115 (seen at FIGS. 1 and 4) formed on each end 116*a*, 116*b* of the cam body 114. The apparatus 100 includes first and second working vanes 110*a*, 110*b* and first and second follower vanes 112*a*, 112*b* that extend into the sloped annular channels 115. The working vanes 110*a*, 110*b* divide each respective sloped annular channel 116 into an inlet chamber and an outlet chamber. In operation, when the cam 108 rotates (e.g. in direction A), the working vanes 110*a*, 110*b* slide within the sloped annular channels 115 so that the inlet chamber expands and receives a fluid, while the outlet chamber contracts and expels the fluid out from the apparatus 100.

Where the cam body 114 is double sided, when the vanes 110*a*, 110*b*, 112*a*, 112*b* are operating on the surface of both ends of the cam body 114, the first working vane 110*a* operates opposed and coincident to the second working vane 110*b* on opposite ends of the cam body 114. The first follower vane 112*a* operates opposed and coincident to the second follower vane 112*b* on opposite sides of the cam body 114. The cam body 114 may be shaped such that there is efficient emptying of the interior chamber 104 as the slope of the ramp up and ramp down portions is lengthened.

The double sided design may provide for a reduction in overall size and materials. The fluid may pass from the first annular channel 115 to the second annular channel 115 via a conduit (not shown) that connects the fluid outlet of the first annular channel 115 to the input of the second annular channel 115.

Figure 9:
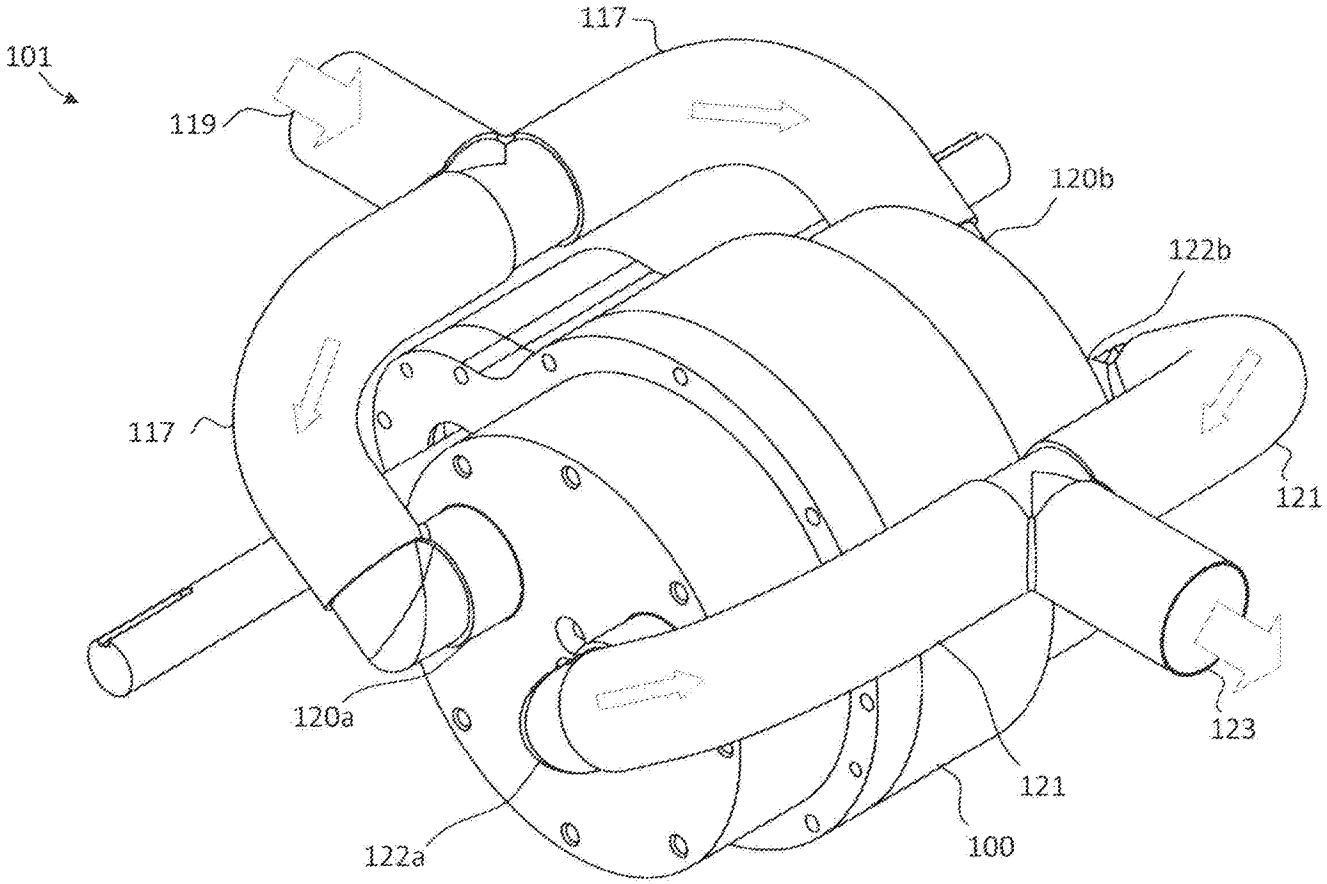
FIG. 9 is a perspective view of an apparatus for driving fluid having inlet and outlet conduits, in accordance with an embodiment.

FIG. 9 illustrates an apparatus 101 for driving fluid, in accordance with an embodiment. The apparatus 101 includes the apparatus 100 as well as an inlet conduit 117 and an outlet conduit 121. The fluid inlet 120*a* of the first annular channel 115 and the fluid inlet 120*a* of the second annular channel 115 are both connected via the inlet conduit 117 to a single conduit inlet 119. Further, the fluid outlet 122*a* of the first annular channel 115 and the fluid outlet 122*a* of the second annular channel 115 are both connected via the outlet conduit 121 to a single conduit outlet 123.

Figure 10:
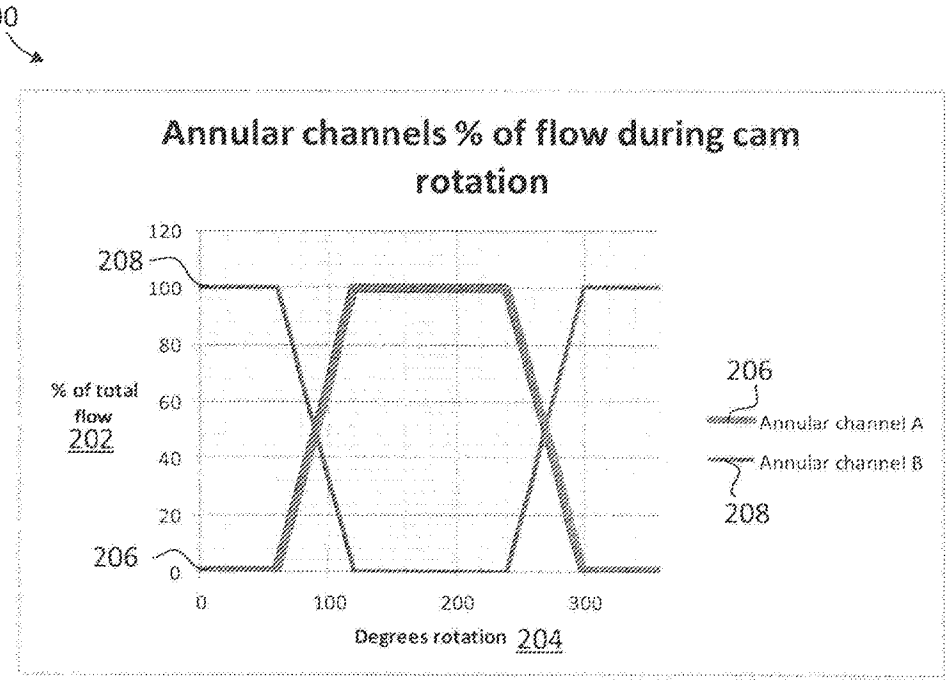
FIG. 10 illustrates a graph of fluid flow for the apparatus of FIG. 9.

FIG. 10 illustrates a graph 200 of fluid flow through the apparatus 101, in accordance with an embodiment. The graph 200 shows the percentage 202 of fluid flow versus degree rotation 204 of the cam for each of the first and second annular channels 206, 208. The graph 200 is based on FIG. 4 being at 0 degrees with the first annular channel shown. The graph 200 shows the flow cycle of one cam rotation. The apparatus 101 may provide for a more even pumping or compression flow thereby reducing pulses in fluid flow as the cam surface in the first annular channel 115 will be opposite to the cam surface in the second annular channel 115. When the first annular channel 115 is pumping its max flow of fluid, the second annular channel 115 will be closed, and when the second annular channel 115 is pumping its max flow of fluid, the first annular channel 115 will be closed. During the ramp portions of the cam body 114, both annular channels will be pumping proportionally to the total flow (i.e., halfway through the one of the ramp portion of each annular channel will be pumping 50% of the total flow).

In an alternative embodiment, the first annular channel 115 drives a first fluid and the second annular channel 115 drives a second fluid. As such, the double sided cam 108 may allow for the driving of two different fluids at the same time.

Alternatively, the cam body 114 may be shaped to be single sided.

Figure 6:
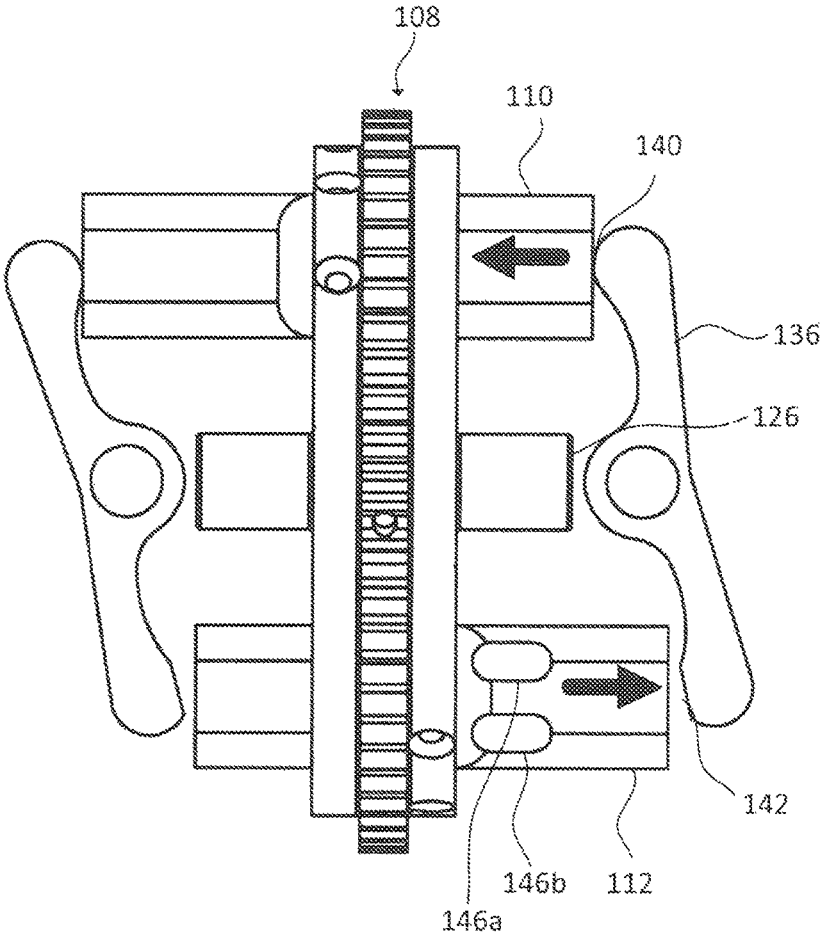
FIG. 6 is second side view the apparatus of FIG. 4.
Figure 7:
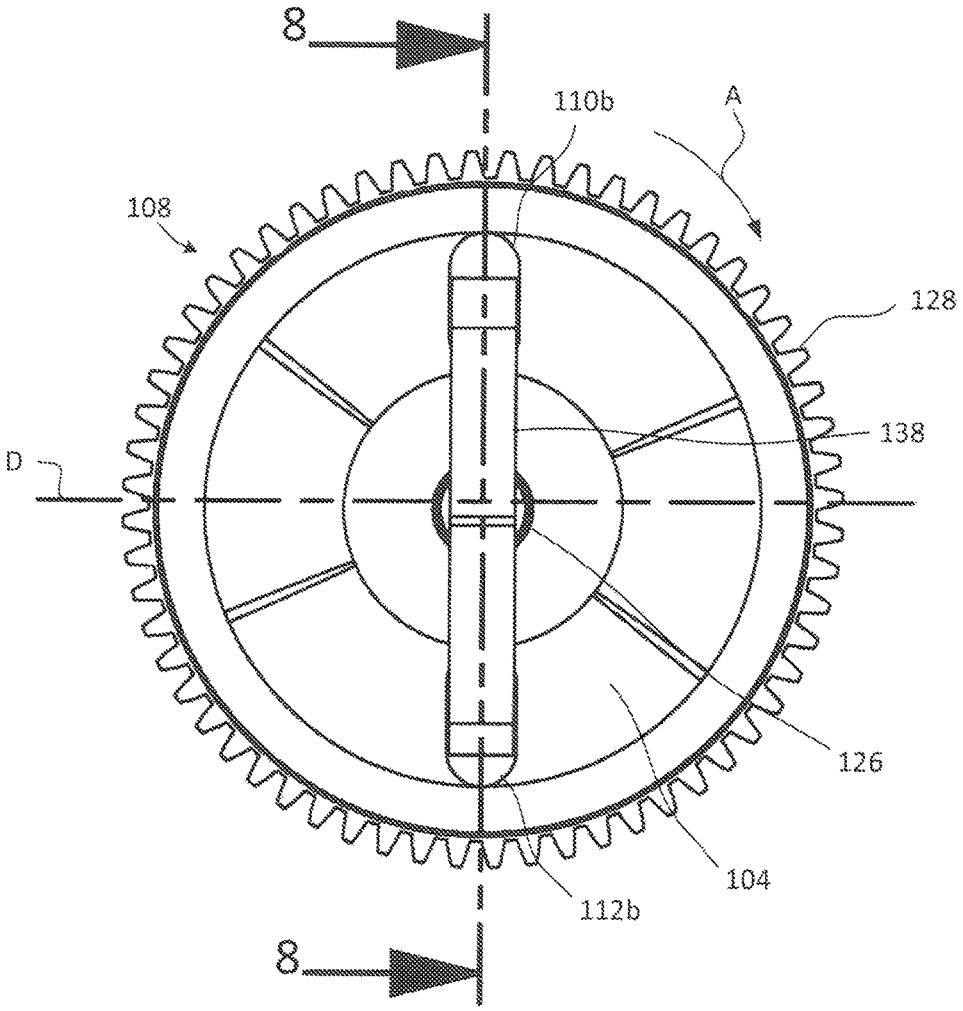
FIG. 7 is an end view the apparatus of FIG. 4.
Figure 8:
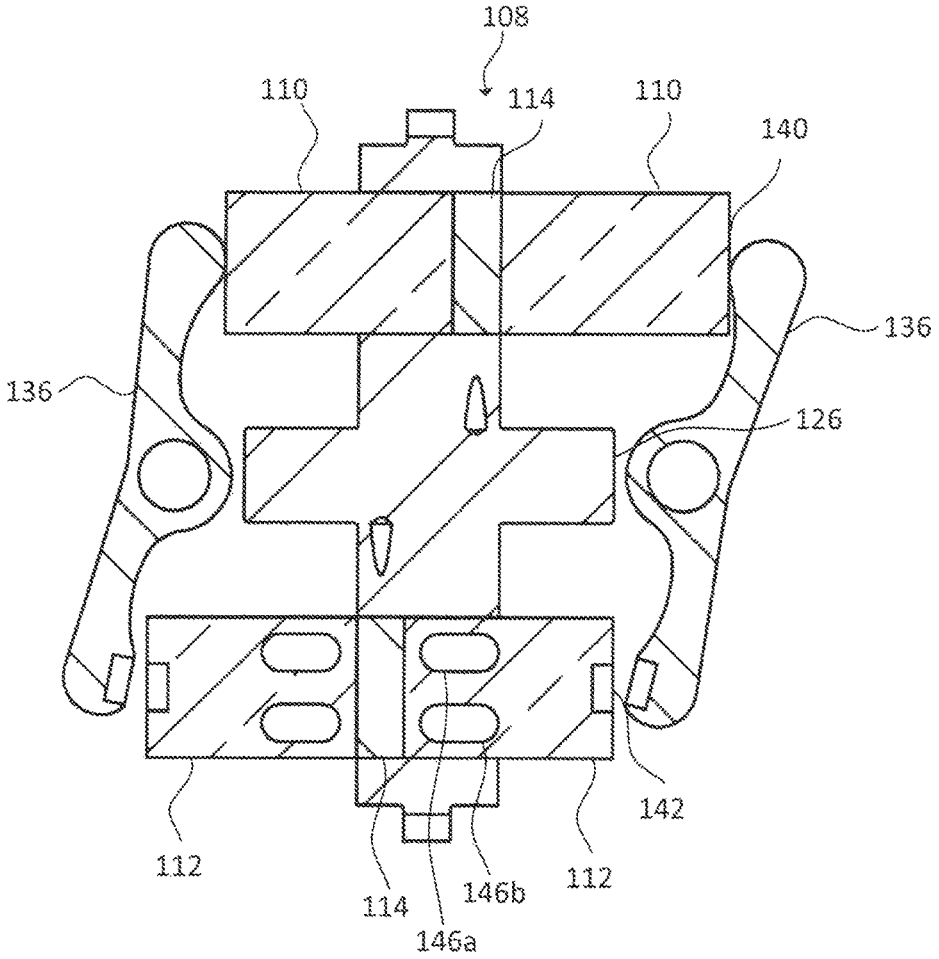
FIG. 8 is a section view of the apparatus along 8-8 of FIG. 7.

Turning now to FIGS. 3, 6, and 8, the operation of the rocker arm 136 will be described in more detail. The rocker arm 136 provides dependent motion between the working vane 110 and the follower vane 112, i.e., the motion of one object is directly related to the motion of the other object. The apparatus 100 includes a rocker mount 137 to pivotally mount the rocker arm 136 to the housing 102 at rocker pivot 138. The rocker arm 136 pivots about rocker arm rotational axis D (shown in FIGS. 4 and 7) in the rocker mount 137. The rocker arm 136 may maintain contact with the vanes 110, 112 when the rotation speed of the cam 108 is reduced.

As seen from FIGS. 3 and 8, the rocker arm 136 has a first arm end at 140 that engages with the working vane 110. The rocker arm 136 has a second arm end at 142 that engages with the follower vane 112. The first and second arm ends are on opposite sides of the rocker pivot 138. As discussed above, the rocker arm 136 provides opposed motion of the working vane 110 relative to the follower vane 112.

The contact point 142 may be contactless (e.g. using biasing elements, such as magnets, springs, or the like). The contact point 142 may allow for expansion where the temperature or pressure of the fluid changes. The contact point 142 may allow for wear. In a similar way, the contact point 140 may also be contactless. In a particular embodiment, the rocker arm 136 frictionally contacts the working vane 110 while, the rocker arm 136 does not contact the follower vane 112, as the working vane 110 may drive the movement of the rocker arm 136. The follower vane 112 may be shorter in length than the working vane 110, as may be seen from FIG. 3. This may allow for space to accommodate features of the contactless contact point 140.

The contact point 142 of the follower vane 112*a* may include magnetic elements 144*a*, 144*b* with magnetically opposing magnetic elements on each side of the contact point 142. The second arm end of the rocker arm 136 includes a rocker magnetic element 144*a*. The follower vane 112 includes a vane magnetic element 144*b* that is magnetically opposed to the rocker magnetic element 144*a*. For example the rocker magnetic element 144*a* may be a North facing magnet, and the vane magnetic element 144*b* may be a North facing magnet, and as such the magnetic elements 144*a*, 144*b* repel from each other. Similarly a South-South configuration may be provided.

As seen at 140 of FIG. 3, the rocker arm 136 may be sized such that when the working vane 110*b* is fully retracted, the rocker arm 136 abuts both the working vane 110*b* and the housing 102. This may prevent the working arm 110*b* from retracting beyond the desired range and prevent the rocker arm 136 from contacting the follower vane 112*b*.

In an alternative, the contact point 142 of the follower vane 112 may include a spring (not shown) connected at one end to the follower vane 112 and at the other end to the second arm end of the rocker arm 136. The spring may include a coil spring or a leaf spring.

In an embodiment, the vanes 110, 112 may be attached to the rocker arm 136. For example, where the fluid is at a constant temperature and pressure, fluid expansion may be avoided.

The apparatus 100 may be used in an engine, an air compressor, a vacuum pump, or the like. The fluid being driven by the apparatus 100 may be a liquid and/or a gas. The apparatus 100 may pump low RPM at the same speed as the fluid flowing through the pipe. Slow speeds may reduce cavitation. In contrast to screw pump or centrifugal pumps, where gears may create high pressures that may create problems with air or foaming of the liquid. In the food industry, the driven fluid may be food stuff such as ketchup, pudding, and corn syrup and unnecessary heating and cavitation may be undesirable. The apparatus 100 may increase the pumping efficiency. The apparatus 100 may be more easily repaired, may be light, and may be compact in design.

While the above description provides examples of one or more apparatus, methods, or systems, it will be appreciated that other apparatus, methods, or systems may be within the scope of the claims as interpreted by one of skill in the art.

The invention claimed is:

1. An apparatus for driving fluid comprising:

a housing having an interior chamber in communication with a fluid inlet for receiving the fluid and a fluid outlet for expelling the fluid;

a cam rotatably mounted within the housing, the cam configured to drive fluid to flow, the cam having an annular channel formed therein;

a working vane extending into the annular channel for sliding therein as the cam rotates, wherein the working vane divides the annular channel into an inlet chamber and an outlet chamber such that, as the cam rotates, the inlet chamber expands and the outlet chamber contracts;

a follower vane extending into the annular channel for sliding therein as the cam rotates, wherein the follower vane has at least one aperture that allows fluid to pass through the follower vane whenever the follower vane extends into the annular channel; and a rocker arm for providing dependent motion between the working vane and the follower vane.

2. The apparatus of claim 1, wherein the rocker arm has a first arm end engaging the working vane and a second arm end engaging the follower vane, and wherein the first and second arm ends are on opposite sides of a rocker pivot to provide opposed motion of the working vane relative to the follower vane.

3. The apparatus of claim 2, wherein the second arm end includes a rocker magnetic element and the follower vane includes a vane magnetic element that is magnetically opposed to the rocker magnetic element.

4. The apparatus of claim 2, further comprising a spring connected at one end to the follower vane and connected at the other end to the second arm end.

5. The apparatus of claim 4, wherein the spring includes a coil spring or a leaf spring.

6. The apparatus of claim 1, wherein the annular channel of the cam is shaped to be symmetrical such that fluid will flow in a reverse direction when the cam is rotated in a reverse direction.

7. The apparatus of claim 1 further comprising a rocker mount pivotally mounting the rocker arm to the housing.

8. The apparatus of claim 1, wherein the cam has a cam rotational axis and the rocker arm has a rocker arm rotational axis and wherein the cam rotational axis is perpendicular to the rocker arm rotational axis.

9. The apparatus of claim 1, wherein the rocker arm frictionally contacts the working vane.

10. The apparatus of claim 1, further comprising a drive mechanism for providing rotation to the cam.

11. The apparatus of claim 1, wherein the follower vane has two apertures to allow fluid to flow therethrough.

12. The apparatus of claim 11, wherein the apertures are sized to have a height that is less than the depth of a follower vane socket.

13. An apparatus for driving fluid comprising:

a housing having a first interior chamber in communication with a first fluid inlet for receiving the fluid and a first fluid outlet for expelling the fluid, and a second interior chamber in communication with a second fluid inlet for receiving the fluid and a second fluid outlet for expelling the fluid;

a cam rotatably mounted within the housing, the cam configured to enable the fluid to flow, the cam having first and second annular channels formed therein;

a first working vane extending into the first annular channel for sliding therein as the cam rotates, wherein the first working vane divides the first annular channel into a first inlet chamber and a first outlet chamber such that, as the cam rotates, the first inlet chamber expands and the first outlet chamber contracts;

a first follower vane extending into the first annular channel for sliding therein as the cam rotates, wherein the first follower vane has at least one aperture that allows fluid to pass through the follower vane whenever the follower vane extends into the first annular channel;

a first rocker arm providing dependent motion between the first working vane and the first follower vane;

a second working vane extending into the second annular channel for sliding therein as the cam rotates, wherein the second working vane divides the second annular channel into a second inlet chamber and a second outlet chamber such that, as the cam rotates, the second inlet chamber expands and the second outlet chamber contracts;

a second follower vane extending into the second annular channel for sliding therein as the cam rotates, wherein the second follower vane has at least one aperture that allows fluid to pass through the follower vane whenever the follower vane extends into the second annular channel; and a second rocker arm providing dependent motion between the second working vane and the second follower vane.

14. The apparatus of claim 13, wherein the first working vane is coincident with the second working vane.

15. The apparatus of claim 14, wherein the first follower vane is coincident with the second follower vane.

16. The apparatus of claim 13 wherein the first fluid inlet and the second fluid inlet are connected via an inlet conduit to a single conduit inlet, and wherein the first fluid outlet and the second fluid outlet are connected via an outlet conduit to a single conduit outlet.

17. The apparatus of claim 13, further comprising a conduit that connects the fluid outlet of the first annular channel to the input of the second annular channel, wherein fluid passes from the first annular channel to the second annular channel.

18. The apparatus of claim 13, wherein the first annular channel drives a first fluid and the second annular channel drives a second fluid.

19. A method of driving fluid comprising:

receiving the fluid via a fluid inlet in communication with an interior chamber and expelling the fluid via a fluid outlet;

rotating a cam mounted within the housing and driving fluid to flow, the cam having an annular channel formed therein;

reciprocating a working vane in the annular channel as the cam rotates, wherein the working vane divides the annular channel into an inlet chamber and an outlet chamber such that, as the cam rotates, the inlet chamber expands and the outlet chamber contracts; and reciprocating a follower vane in the annular channel as the cam rotates, wherein the follower vane has at least one aperture that allows fluid to through the follower vane whenever the follower vane extends into the annular channel, wherein extension of the follower vane is dependent on the retraction of the working vane.

20. The method of claim 19 further comprising providing opposed motion of the working vane relative to the follower vane.

* * * * *